United States Patent [19]

Krueger et al.

[11] 3,943,031

[45] Mar. 9, 1976

[54] LAMINATING APPARATUS

[75] Inventors: Theodore H. Krueger, Wayland; David B. Spaulding, Carlisle, both of Mass.

[73] Assignee: Seal Incorporated, Derby, Conn.

[22] Filed: May 14, 1973

[21] Appl. No.: 359,663

[52] U.S. Cl. ..... 156/583; 53/89; 100/137; 100/140; 100/164; 156/306

[51] Int. Cl.[2] ..... B30B 15/34; B32B 31/00

[58] Field of Search ..... 53/39; 100/137, 140, 164; 156/306, 580, 583, 555

[56] References Cited

UNITED STATES PATENTS

| | | | |
|---|---|---|---|
| 3,391,047 | 7/1968 | Kopp | 156/553 |
| 3,453,165 | 7/1969 | Isbey et al. | 156/555 X |
| 3,481,376 | 12/1969 | Keller | 144/281 |
| 3,660,207 | 5/1972 | Schrade et al. | 156/555 |
| 3,660,210 | 5/1972 | Chapman | 156/583 |
| 3,779,845 | 12/1973 | Hutz et al. | 156/87 |

*Primary Examiner*—William A. Powell
*Assistant Examiner*—Brian J. Leitten
*Attorney, Agent, or Firm*—Schiller & Pandiscio

[57] ABSTRACT

The invention is a simplified roller-type apparatus for laminating articles in sheet form with transparent plastic laminating film. It comprises a heating station for heating the work and a pair of pressure rolls for bonding the film to one or both sides of each article. The heating station comprises a pair of vertically opposed flat plates that are separable to permit the work to be inserted between them, and means for heating the plates so that they act as sources of heat for activating the adhesive layer of the laminating film. In the preferred embodiment, the lower plate is fixed and the upper plate is mounted for vertical movement relative to the lower plate. The two plates also act as guides for directing the heated work into the nip formed by the pressure rolls.

14 Claims, 12 Drawing Figures

LAMINATING APPARATUS

This invention relates to a laminating apparatus and more particularly to an improved apparatus for laminating thin films of plastic material to paper and similar materials.

As is well known in the art, a variety of devices have been proposed in the past for laminating a transparent plastic film to one or both sides of a sheet of paper, e.g. a printed or typewritten document, a photograph, etc., for the purpose of protecting it against ageing and physical damage. Prior laminating devices most often have been in the form of flat type platen presses or rotary laminating presses. The latter type of press is exemplified in U.S. Pat. Nos. 3,143,454, 3,138,695 and 3,401,439. Flat platen presses are generally considered unsatisfactory because they are slow and because a substantial amount of skill and care is required to obtain a substantially flawless lamination and to avoid thermal degradation of the laminating film and the substrate to which the film is bonded. Two types of rotary laminating presses are well known. In one type, the plastic laminating film material is heated immediately prior to passage of the film material and substrate through a pair of pressure rollers. The second type avoids the use of a separate heating station and instead utilizes heated pressure rollers which heat the sheet materials precisely at the point of pressurization. For the most part, roller type laminators have been relatively complicated. A particular problem has been to get application of heat evenly to the laminating materials without degrading the latter. To overcome such difficulty and also to minimize control adjustments, a great deal of effort has been expended in devising heated, spring-biased pressure rolls which will exhibit relatively small variations in surface temperature during laminating operations. However, the use of heated rollers involves other difficulties such as heater burnout, roller degradations, and the use of slip-rings or other means of supplying current to the heating elements associated with the rollers. Many roller-type laminators also have been designed to utilize laminating film in roll form, with means being provided to feed the film under tension to the pressure rollers for bonding to the substrate which is fed in separately. Additionally means are required to sever the laminating film. While such machines offer the advantage of avoiding wrinkling of the film, they are relatively expensive to purchase and also to maintain in good operating condition.

The primary object of this invention is to provide a roller laminator which overcomes the foregoing and other disadvantages and limitations of prior roller laminators.

Another object is to provide a roller laminator which avoids the use of heated pressure rollers.

A further object is to provide a roller laminator in which precut sheets of plastic laminating film can be used.

Another object is to provide an improved method of bonding a protective laminating film to an article in sheet form.

A more specific object is to provide a relatively inexpensive roller laminator of simplified construction which is easy to operate and maintain in good operating condition.

Described briefly, the invention comprises a pair of resilient pressure rollers that are unheated and a heat station located immediately in front of the rollers which consists of a heated substantially flat platen and a work support plate located below and normally engaging the platen, with either platen or work support plate being movable so as to permit a workpiece to be inserted between them and advanced into the nip of the pressure rollers. The workpiece, which consists of a document or like article with one or both of its opposite sides engaged with a precut sheet of plastic laminating film, is heated by the platen and work support plate to a temperature high enough to activate the adhesive coating of the plastic film, and the heated workpiece is compressed by the rollers so that the adhesive layer forms a continuous uniform bond between the article and the film. A carrier folder for the workpiece is used to facilitate introduction thereof between the platen and work support plate. The rollers are yieldably mounted so as to be separable to the extent required to accommodate the workpiece and spring means are provided for pressing the two rollers into tight gripping and compressing relation with the workpiece. In the preferred embodiment of the invention, the work support plate is stationary and the platen assembly, which normally rests on the work support plate of its own weight, is capable of "floating" with respect to the work support plate as the work is inserted and moves between them.

Other features and many of the attendant advantages of the invention are disclosed in or rendered obvious by the following detailed description which is to be considered together with the accompanying drawings in which.

In the drawings like numerals refer to like parts.

Figure 1:
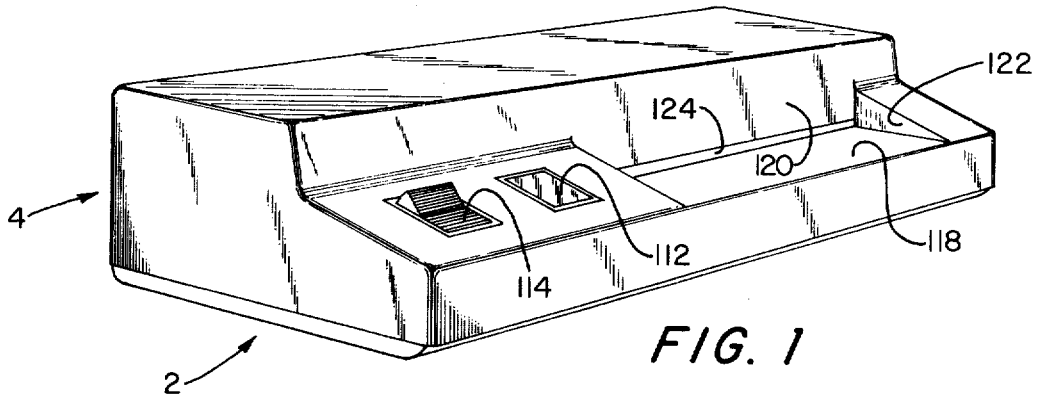
FIG. 1 is a perspective view of a laminator constituting a preferred embodiment of the invention.

A number of transparent film materials may be used for laminating with devices made in accordance with this invention. Polyester, films, notably those consisting of a polyethylene glycol ester of terephthalic acid, are preferred because of their resistance to tearing, heat and abrasion, high strength, good ageing characteristics, substantial inertness, and high degree of imperviousness to moisture. These polymer films are provided with suitable adhesive layers which are transparent and should be capable of being heated without noticeable degradation and of forming a strong bond between the film and a suitable substrate. Typically the adhesive is a thermoplastic material, polyethylene being preferred, which is activated, i.e. softened, by heat and adheres to the adhesive under application of pressure.

Referring now to the drawings, the machine comprises a housing consisting of a base 2 and a cover 4 formed of plastic or other suitable material. The base 2 has a flat bottom wall, integral front, back and side walls. Mounted on and secured to the bottom wall of base 2 by screws (not shown) is a flat baseplate 6 which forms part of the chassis of the operating mechanism of the machine. The chassis includes three vertical mounting plates or brackets 8, 10 and 12 which are secured to the base plate. The upper ends of plates 8 and 10 are formed with right angle flanges 13 and 14 respectively. Extending between plates 8 and 10 is a relatively thick plate 16 which preferably is made of aluminum or an aluminum alloy or some other material combining high heat conductivity with adequate strength. Plate 16 is secured in place by machine screws 18 that extend through plates 8 and 10 and are screwed into tapped holes in the end faces of plate 16. Flat heat insulators 19, preferably made of silicone sponge rubber, are located between the end faces of plate 16 and brackets 8 and 10. Plate 16 has a flat upper surface 20 and is disposed so that the latter surface is substantially horizontal. A conventional bimetallic thermostat switch 21 is attached by screws to the flat underside of plate 16.

Plate 16 acts as a support tray or shelf and also as a guide for the workpiece to be laminated. Disposed above and resting on plate 16 is a heated platen or shoe identified generally by the numeral 22. The platen comprises a relatively thick plate 24 that has a flat bottom surface and is bevelled at its front end so as to form an inclined surface 23 to provide an entranceway or mouth for the workpiece. Plate 24 has a relatively wide and flat-bottomed groove or channel 25 in its upper surface to accommodate a flat electrical heater unit 26. The latter is concealed by a cover plate 28 that is secured tightly to plate 24 by screws 30. A conventional bimetallic thermostat switch 32 is secured by screws to the platen at approximately the center of its channel 25. The heater unit 26 and cover plate 28 are provided with aligned apertures 34 and 36 respectively through which projects the body of the thermostat switch and its terminal leads. Although not shown in detail, it is to be noted that the heater unit 26 preferably consists of an etched stainless steel foil electrical resistance heater element encased in a silicone rubber sheath which is secured to the platen by a suitable heat resistant cement. The terminal leads of the heater unit are brought out of one end as shown at 38. Of course, other forms of electrical heater units may be used.

Extending through correspondingly located holes in flanges 13 and 14 are screws 40 and 42 which are screwed into nuts 44 and 46 respectively. Nuts 44 and 46 are affixed to flanges 13 and 14. Screws 40 and 42 extend down close to the upper surface of plate 16. Cover plate 28 has side extensions 48 which extend beyond the ends of the plate 24 and are notched as shown at 50 so as to allow screws 40 and 42 to extend down along side the ends of the platen plate 24. Notches 50 are located and sized so that the platen assembly 22 is free to move vertically with screws 40 and 42 acting as guides that restrain the platen assembly against movement side to side and fore and aft.

Figure 3:
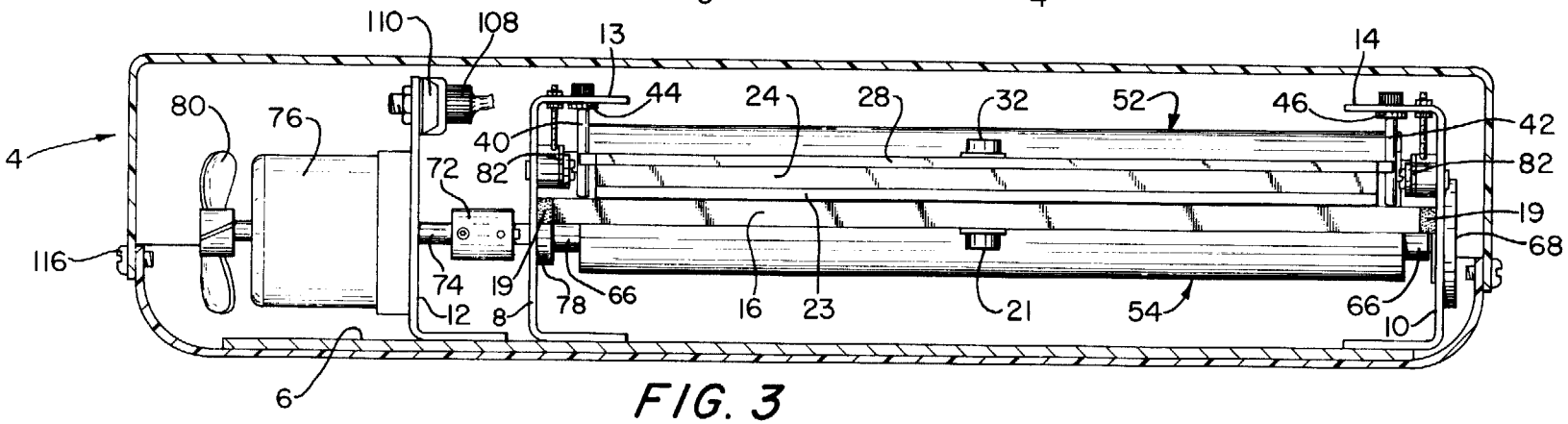
FIG. 3 is a vertical sectional view taken along line 3—3 of FIG. 2.
Figure 5:
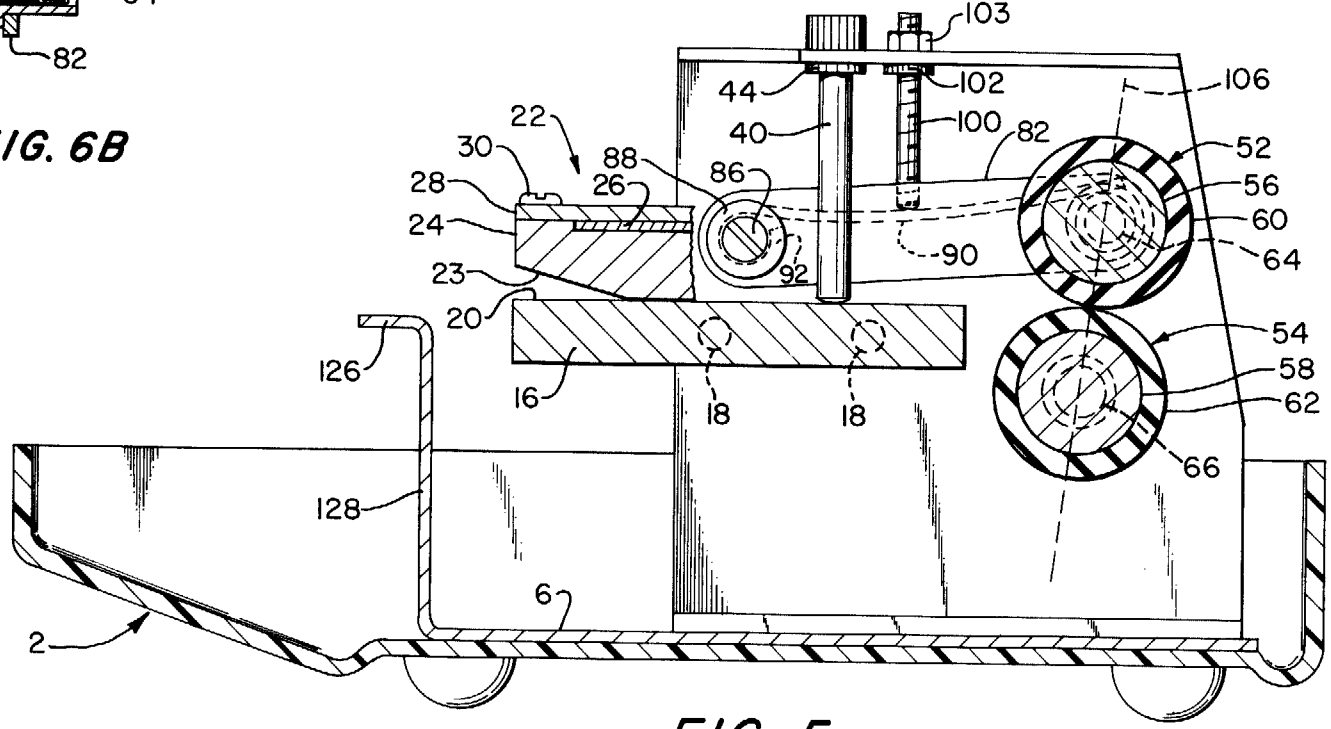
FIG. 5 is a cross-sectional view taken along line 5—5 of FIG. 2.

Brackets 8 and 10 also act as support members for two rollers 52 and 54. As shown in FIGS. 5, rollers 52 and 54 comprise solid metal cores 56 and 58 of circular cross-section and cylindrical covers or sheaths 60 and 62 respectively made of a suitable elastomer such as silicone rubber. The sheaths 60 and 62 may be affixed to the cores by a shrink-fit or may be molded in place. In any event, the sheaths and cores form integral structures. Affixed in the opposite ends of cores 56 and 58 are coaxial dowels 64 and 66. The dowel 66 at the right hand end of roller 54 (as seen in FIG. 3) extends through an oversized hole in bracket 10 and is journalled in a bearing plate 68 which is affixed by screws 70 to bracket 10. The dowel 66 at the opposite end of roller 54 extends through bracket 8 and is attached to a coupling 72 mounted on the output shaft 74 of a gear reducer section of an electric motor unit 76 that is affixed to bracket 12. A bearing 78 affixed to bracket 8 may be used to journal the dowel 66 that is attached to coupling 72. A cooling fan 80 is attached to and driven by another output shaft of the motor unit.

Figure 6A:
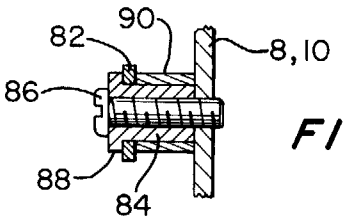
FIGS. 6A and 6B are enlargements of details of the machine.

The upper roller 52 is supported by a pair of elongate guide arms 82, each of which is pivotally secured at one end to one of the brackets 8 and 10. Referring now to FIG. 6A, a bushing 84 is mounted by a screw 86 to the inner surface of each of the brackets 8 and 10. Each bushing has a flange 88 adjacent to the head of its mounting screw 86. Each bushing 84 extends through a suitably sized hole in the associated guide arm 82 and acts as a bearing for the guide arm. Each bushing also acts as a mount for one end of a leaf spring 90. The aforesaid end of each spring 90 is bent to form a collar or loop portion 92 which embraces the associated bushing 84.

Figure 6B:
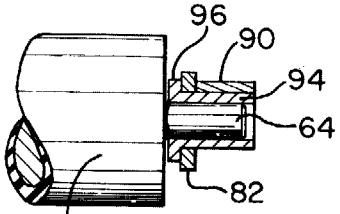

The end dowels 64 of upper roller 52 are rotatably mounted to the rear ends of guide arms 82. Referring now to FIG. 6B, a bushing 94 is mounted on each dowel. Each bushing 94 has a flange 96 and extends through a suitably sized hole in the rear end of one of the guide arms 82. The springs 90 are long enough to extend rearwardly over the bushings 94, with the guide arms situated between the bushing flanges 96 and springs 90. The guide arms coact with the bushings 94 to limit axial movement of roller 52 while permitting the latter to rotate on its axis. The roller 52 is urged downward into engagement with roller 54 by the leaf springs 90. The latter are biased by screws 100 which extend through holes in flanges 13 and 14 and are screwed into nuts 102 affixed to the aforesaid flanges. Screws 100 are adjusted so as to bear against the springs which tend to bend as shown in FIG. 5 while exerting a downward pressure on the roller 52 through bushings 94. The downward pressure exerted on roller 52 can be adjusted by moving the screws up or down. Lock nuts 103 are used to hold screws 100 in a set position.

As seen in FIG. 5, the roller 54 is disposed at a height such that it is substantially tangent to the plane of the upper surface of the work support plate 16. Additionally, the length of the guide arms is such that when the two rollers are engaged, the axes of the two rollers are offset so that a plane common to their axes will be inclined substantially as shown by the dotted line 106. Preferably the rollers are disposed so that the axis of roller 52 is offset rearwardly of the axis of roller 54 by an angle between about 5° and about 12° and preferably between about 6° and 8° from the vertical. By way of example, if the rollers each have a diameter of 1⅛ inch, the roller 52 is disposed so that its axis is set back of the axis of roller 54 by about ⅛ inch.

Figure 2:
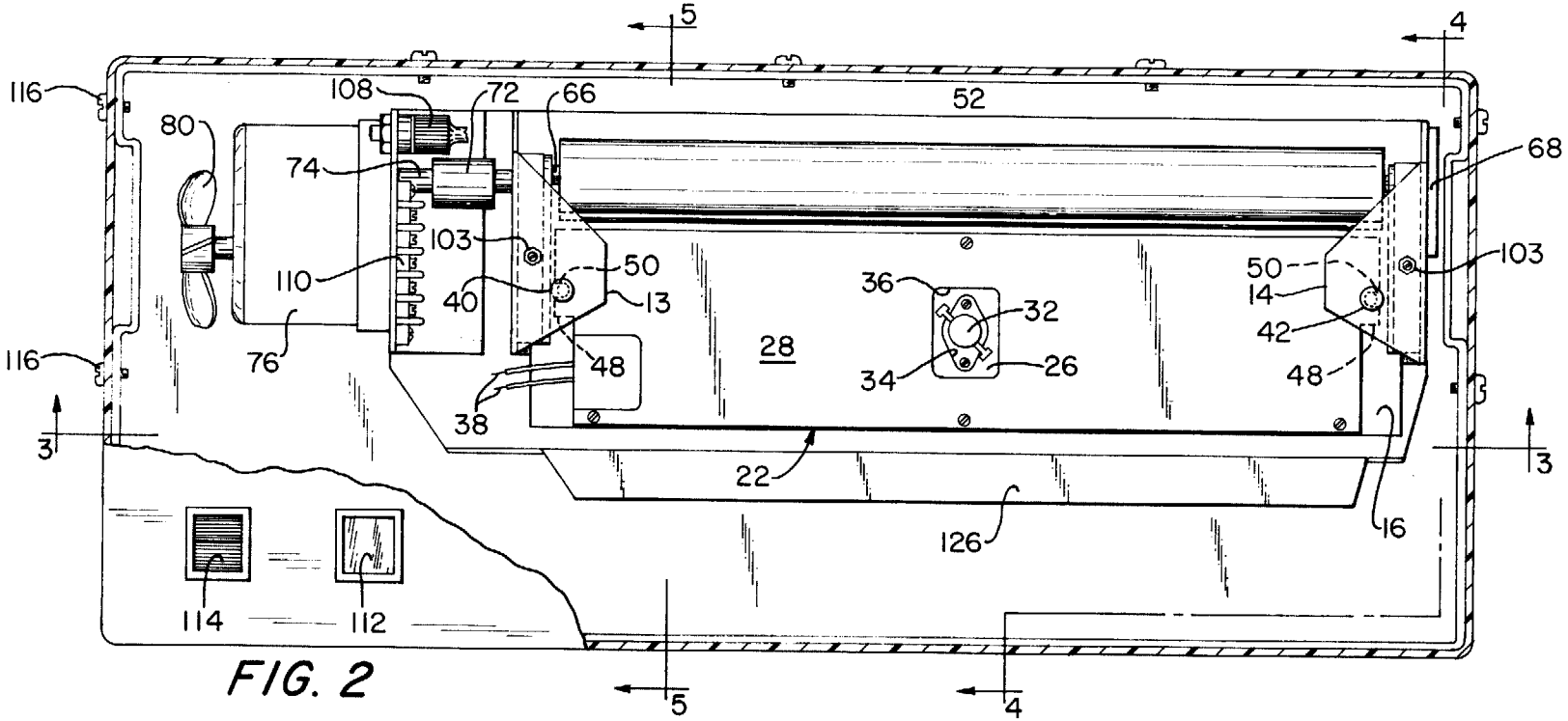
FIG. 2 is a plan view of the machine of FIG. 1 with a portion of the housing broken away to expose the operating mechanism.

Referring now to FIGS. 2 and 3, the machine also includes a solid state relay 108 and a terminal board 110 affixed to bracket 12. These components are connected in a circuit in the manner shown in FIG. 9 to thermostats 21 and 32, heater element 26 and motor 76. Also connected in the circuit are a Ready light 112 and an ON-OFF switch 114 which are mounted in the machine's cover 4.

The cover 4 fits down over the base 2 and is secured to it by screws 116. One or more of the side and rear walls of the cover and preferably also the base are provided with vent holes (not shown) to facilitate circulation of cooling air by fan 80. The front side of the cover is formed with a horizontal shelf 118 and a vertical front wall section 120 located between vertical side wall sections 122 plus a horizontal elongated opening 124 formed therebetween. The inner edge of shelf 118 is supported by a flange 126 formed on the upper end of a vertical extension 128 of baseplate 6. Shelf 118 is located so that its upper surface is at substantially the same level as the upper surface of plate 16. Preferably the opening 124 is located within about ¼ inch of the front edge of plate 16. The rear side of the platen 22 also extends close to the nip formed by rollers 52 and 54. Preferably the spacing between platen 22 and roller 52 is about ¼ – ⅜ inch.

Figure 9:
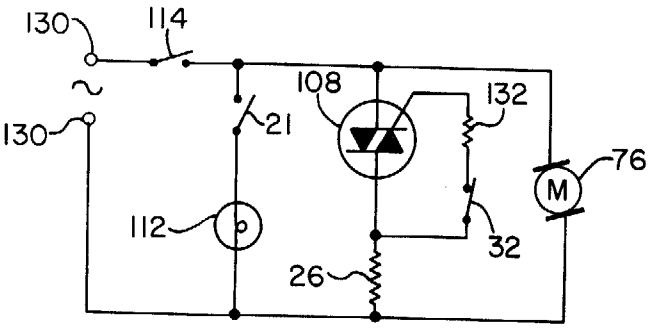
FIG. 9 is a diagram of the power circuit of machine.

As seen in FIG. 9, the circuit comprises two input terminals 130 adapted for connection to a suitable source of a.c. current. In practice, terminals 130 constitute the prongs of the plug connector of a power cord (not shown) which is connected to terminal board 110 and extends out through a hole in the base 2 or the cover 4 of the housing. The solid state relay 108 comprises a triac having its $T_1$ and $T_2$ terminal connected in series with switch 114 and heater unit 26 between input terminals 130. Thermostat 21 and READY light 112 are connected in parallel with the triac and the heater unit. Motor 76 is also connected in series with switch 114 and terminals 130. The gate electrode of the triac is connected by a bias resistor 132 and thermostat 32 to the junction of the triac and heater unit 26. Thermostat 21 is normally open and is set to close when the work support plate reaches a suitable temperature indicative of the fact that the machine is ready to carry out a laminating operation. Light 112 goes on when thermostat 21 closes. The thermostat 32 is normally closed and is set to open when the platen assembly reaches a temperature level above which the work may suffer heat damage. The temperature settings selected for the two thermostats depend on (1) the activating temperature of the adhesive coating on the laminating film (or films) that form a part of the workpiece and (2) the resistance to heat degradation of the film and other components of the workpiece. Typically with the platen assembly and work support plate each having a thickness in the order of ⅜ – ½ inch and using a laminating film coated with an adhesive that is activated in the range of about 250°F and about 325°F, the thermostat 21 is set to close at about 250°F and the thermostat 32 is set to open at about 350°F. Assuming that switch 114 is closed, triac 108 will conduct and heater unit 26 will be energized as long as thermostat 32 is closed. The triac will stop conducting and the heater unit will be deenergized when thermostat 32 opens. Motor 76 will operate as long as switch 114 is closed.

Platen assembly 22 and work support plate 16 are made sufficiently massive such that at temperatures between 250°F and 350°F the amount of heat which they give up to a typical workpiece as the latter moves through the machine causes their temperatures to drop no more than about 5°–20°F when the heater unit is off, and the heater unit is made so that its heat output is sufficient to maintain the platen assembly and the workpiece at a sustantially constant temperature during normal use of the machine. It has been found that if the platen assembly and work support plate are made of aluminum, and if the motor is adapted to rotate roller 54 at a surface speed of 50 inches/minute, highly satisfactory laminations can be achieved following the procedure described below if (a) the heater unit has a watt density of about 28 watts/square inch; (b) the platen assembly 24 has a maximum thickness of ½ inch (with a heater channel depth of about 1/16 inch) and a depth (i.e., front to back dimension) of 3 inches; (c) the support plate 16 is ⅜ inch thick and 3 inches deep; and (d) thermostats 21 and 32 are set to close and open respectively at 250°F and 350°F respectively.

Figure 7:
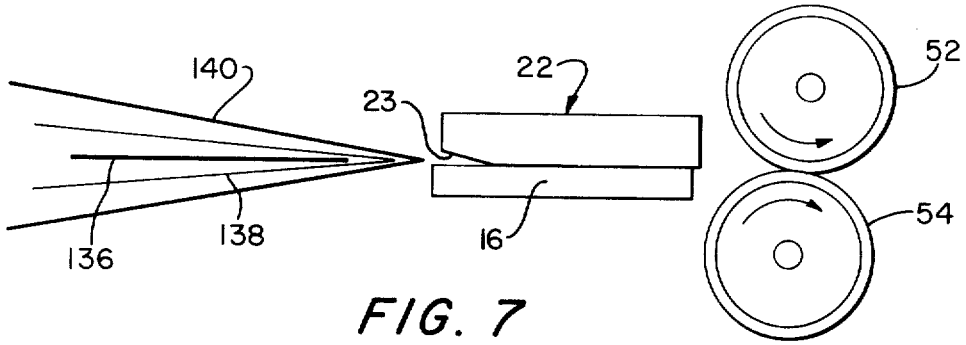
FIGS. 7 and 8 are schematic views showing various elements and the process of lamination.
Figure 8:
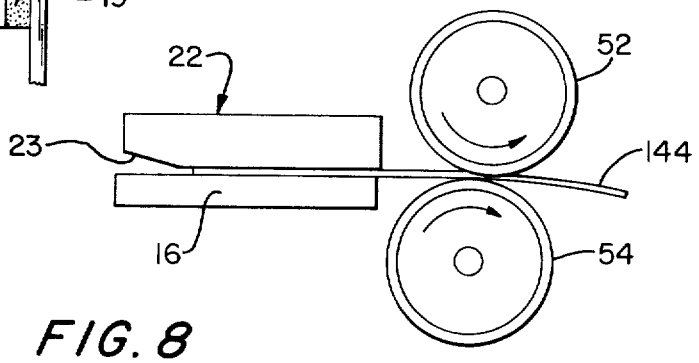
Figure 4:
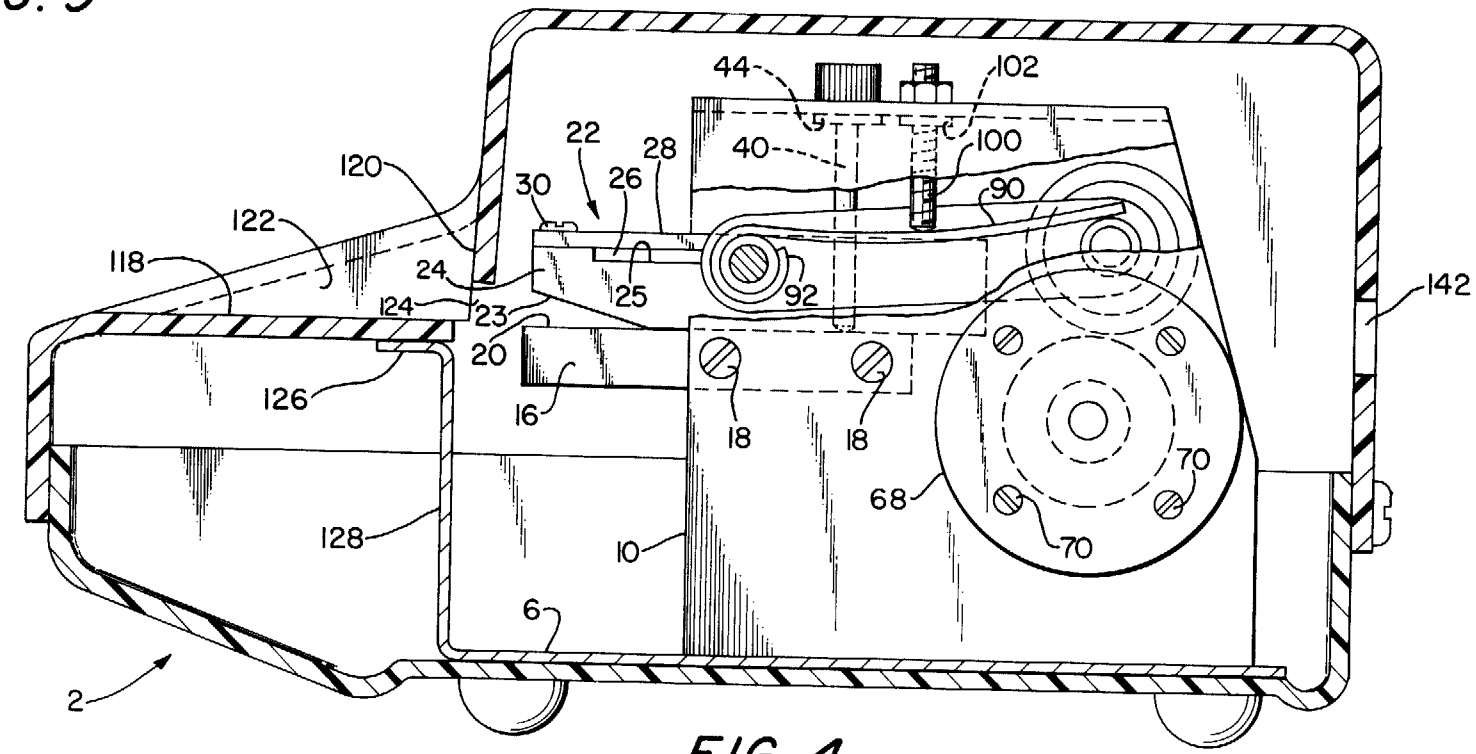
FIG. 4 is a vertical sectional view, with portions broken away and removed, taken along line 4—4 of FIG. 2.

FIGS. 7 and 8 illustrate how a typical laminating operation is effected. In this case assume that the object 136 to be laminated is a photograph. A sheet of 0.001–0.003 inch laminating film coated on one side with a heat activatable adhesive is folded over the photograph as shown at 138, and the resulting workpiece is placed within a carrier folder 140 which is relatively stiff. By way of example, the folder may be formed of 0.010 inch thick Manila stock. The folded end of the carrier folder is inserted through the opening 124 and pushed between platen assembly 22 and support plate 16. The carrier is pushed through between the platen assembly and work support plate until its folded leading edge enters the nip between the two rollers, whereupon the folder is gripped and propelled rearwardly. The laminated product 144 exits the machine via a horizontally elongated discharge slot 142 formed in the rear wall of the machine cover (see FIG. 4). Since the platen assembly is resting on the plate 116 under solely its own weight, it moves up on screws 40 and 42 relatively easily under the separating force exerted by the carrier folder as it is pushed in by the operator. Since the depth or front to back dimensions of the platen assembly and work support plate need only be in the order of about 3 inches and since these elements can be located close to the rollers, it is an easy matter for the operator to quickly feed the workpiece in far enough for it to be picked up by the rollers. The platen assembly and the work support plate coact to guide the workpiece so that the leading edge of the carrier will move straight into the nip of rollers 52 and 54. Additionally, they tend to smoothen out the workpiece and thus eliminate wrinkles. Most importantly, they heat the workpiece up to the necessary adhesive-activating temperature before it is engaged by the rollers. Although pressure is exerted on the workpiece by the platen, substantially most of the bonding of laminating film to the object is effected by the pressure exerted by the rollers, and this pressure can be modified as required by adjusting screws 100. Actually the unheated rollers may be viewed as chill rollers since they tend to rapidly cool the work and thereby set the adhesive which bonds the laminating film to the work object.

Of course, it is not necessary to laminate both sides of a work object, in which case a single sheet of laminating film (having the same or slightly larger dimensions than the work object) is placed in the carrier in engagement with one side of the work object.

Figure 10:
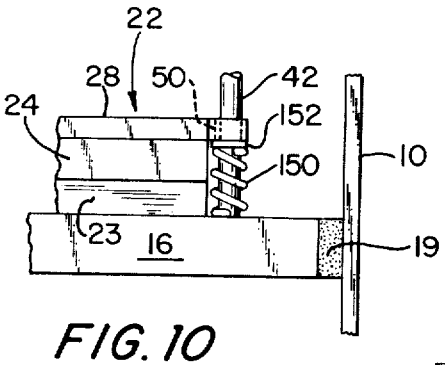
FIG. 10 is a fragmentary sectional view of a modification of the invention.

Although it is not necessary, means may be provided for facilitating separation of the platen assembly 22 from the plate 16 by insertion of the carrier with the enclosed workpiece. This modification of the invention is shown in FIG. 10 where a compression spring 150 surrounds the guide screw 42, with the bottom end of the spring directly engaging plate 16 and the upper end engaging a washer 152 that bears against the underside of the extension 48 of the platen assembly cover plate 28. Although not shown, it is to be understood that a like compression spring 150 is similarly mounted on the other guide screw 40. In this modification the springs have a stiffness and size such that they cannot hold the platen assembly out of engagement with plate 16 but act to balance off a portion of the total weight of the platen assembly, with the result that less of a wedging force is required to be exerted by the inserted carrier to effect separation of the platen assembly from plate 16. Preferably the springs are adapted to balance off about half of the weight of the platen assembly, thereby assuring intimate contact and thus good heat transfer between the platen assembly and the carrier.

It also is contemplated that the work support plane 16 may be provided with an electrical heater unit in the same manner as the platen assembly. However, such additional heater unit is not required for satisfactory operation since the platen engages the work support plate and thus heats it by conduction between laminating operations.

Figure 11:
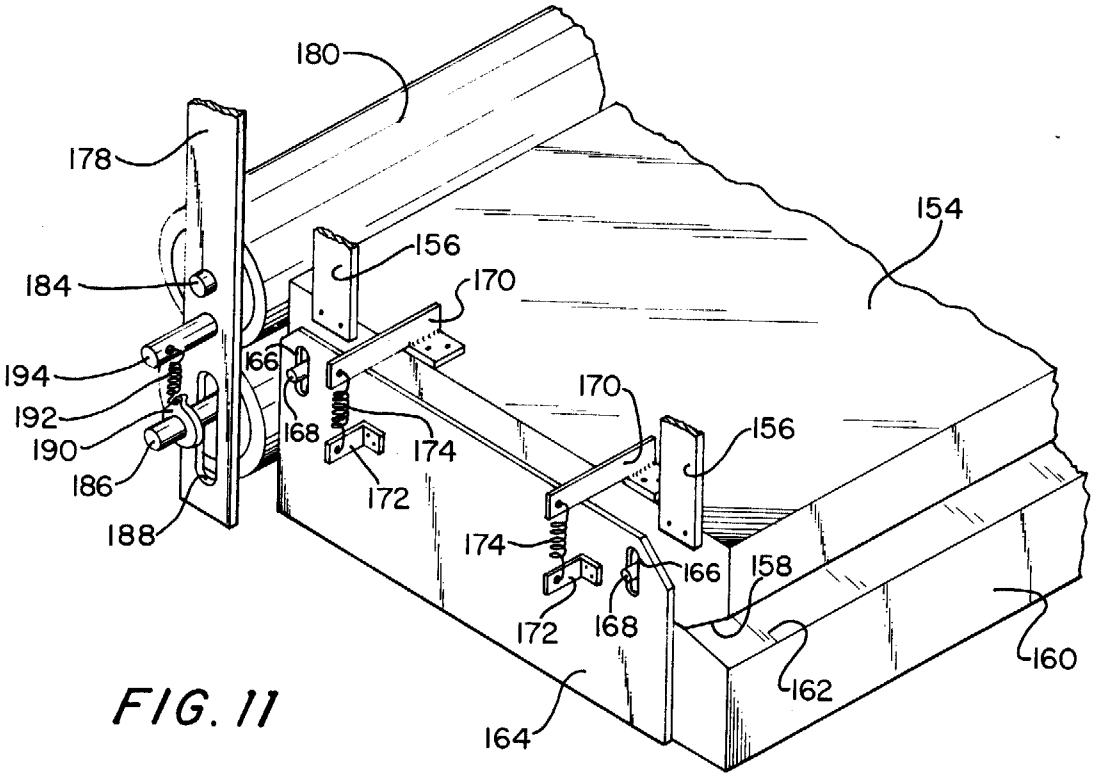
FIG. 11 is a fragmentary perspective view of another embodiment of the invention.

Another possible modification is to fix the platen assembly and mount the work support plate so that it can move vertically with respect to the platen assembly. Such a modification is shown in FIG. 11 where a platen 154 is affixed to and suspended from a frame (not shown) by means of a pair of rigid vertical support arms 156. Although not shown, it is to be understood that platen 154 is provided with an electrical heater element in the same manner as platen assembly 22. The front end of platen 154 is bevelled as shown at 158. Disposed below the platen is a work support plate 160. The latter and platen 154 both are relatively thick so as to function as relatively large sources of heat like the corresponding elements 16 and 22 of the preferred embodiment already described. The front end of plate 160 is bevelled as shown at 162. The bevelled surfaces 158 and 162 form a tapered mouth which facilitates insertion of a workpiece to be laminated.

Affixed to each of the opposite side surfaces of work support plate 160 are vertical side plates 164 which extend up along and slidingly engage the corresponding side surfaces of platen 154. Each side plate 164 is formed with two vertically elongate guide slots 166 and extending into these slots are pins 168 that are secured in the sides of the platen. The pins are sized so as to permit vertical movement of the work support plate relative to the platen. The work support plate is held against the platen by resilient biasing means which consist of brackets 170 affixed to the upper surface of platen 154 adjacent each of its opposite sides, brackets 172 affixed to the side plates 164, and tension springs 174 connected between 170 and 172. It is to be noted that two pairs of brackets 170 are attached to the platen, two at each side, and that these brackets (and also the brackets 172 to which they are connected) are spaced so that the work support plate is supported at four distinct points, whereby the work support plate will tend to be held flat against the platen. Of course, the upper and lower surfaces of plate 160 and platen 154 are flat.

Located proximate to but spaced from the platen and work support plate are two pressure rolls 180 and 182 that preferably have the same construction as rolls 52 and 54. The rollers are unheated. Each of the opposite ends of roll 180 is provided with a dowel pin 184 that is journalled in vertical stanchion plates 178. The latter are affixed to and suspended from the frame (not shown). Although not shown, it is to be understood that the upper roll 180 is connected to and driven by a motor unit in the same manner that roll 54 is connected to and driven by motor unit 76. The lower roll 182 has dowel pins 186 extending through vertically elongate slots 188 formed in stanchion plates 178, the slots being formed so as to prevent the dowels 186 and roll 182 from moving horizontally while permitting them to reciprocate vertically toward and away from roll 180. Roll 182 is resiliently biased upward into contact with roll 180 by means connected to its dowel 186. Such means comprise a collar 190 mounted on each dowel 186 so as to be capable of relative rotational but not relative axial movement. Connected to each collar 190 is a tension spring 192 which also is anchored to a dowel 194 affixed to and projecting from the associated stanchion plate 178. Roll 180 is located so that on its bottom side it is tangent to an extension of the bottom surface of platen 154, and the springs 192 connected to the opposite ends of the bottom roller 182 maintain the latter against roller 180.

Of course, thermostats like thermostats 21 and 32 may be attached to plate 160 and platen 154 and the operating circuit for the heater and the motor drive for roll 180 may be as shown in FIG. 9.

Operation of the device of FIG. 11 is similar to that of the preferred embodiment described above except that the work support plate rather than the platen is displaced when a carrier with a workpiece to be laminated is inserted between them. Springs 174 are formed so that the platen and work support plate are normally contacting each other but can be readily separated by the wedging force of a hand-fed carrier and workpiece. The work support plate is heated by conduction from the platen so that the both of them function as heat sources for the workpiece. The workpiece is heated by the platen and work support plate and is compressed to form a laminated product as it passes between the pressure rolls. As in the preferred embodiment, the work support plate may be provided with a heater unit if desired, but such is not necessary since it is heated by the platen.

As a further modification, the heater unit may be installed in the work support plate instead of the platen. Still other modifications will be obvious to persons skilled in the art.

Although the illustrated embodiments have been described in connection with application of laminating film to articles in sheet form, they also may be used for dry-mounting articles to supporting substrates using conventional dry-mounting tissue. Furthermore, as persons skilled in the art will appreciate, laminating and dry-mounting may be accomplished simultaneously.

What is claimed is:

1. Laminating apparatus comprising a chassis, a pair of pressure rolls supported by said chassis and mounted for rotation on their own axes, at least one of said rolls being movable toward and away from the other of said rolls, spring means resiliently biasing said rolls into pressure engagement with each other, a heating station comprising a platen and a work support member for guiding a multi-sheet workpiece to be laminated into the nip formed by said rolls; said platen being disposed above said work support member with said platen and work support member having confronting heat conductive surfaces that are in engagement with each other, means for securing said work support member against movement relative to said chassis, means mounting said platen for movement toward and away from said work support member so that said platen normally rests on said work support member of its own weight and is capable of floating when a workpiece to be laminated is inserted between them and positioned in the nip of said rolls, means for heating said platen and work support member to a selected temperature, and drive means for continually rotating at least one of said rolls to draw said workpiece from said heating station through said rolls so that the sheets of said workpiece are forced into face-to-face pressurized contact.

2. Apparatus according to claim 1 wherein said heating means is an electrical heating unit mounted to said platen.

3. Apparatus according to claim 1 wherein the confronting surface of said work support member lies in a plane that is substantially tangent to the surface of one of said rolls at said nip, and further wherein said apparatus consists of only a single pair of pressure rolls.

4. Apparatus according to claim 1 including means for guiding said platen in its movement toward and away from said work support member.

5. Apparatus according to claim 1 further including means connected to said work support member for guiding said platen toward and away from said work support member and spring means opposing the downward force exerted by the weight of said platen.

6. Apparatus according to claim 1 wherein the confronting surface of said work support member is aligned with the nip of said rollers.

7. Apparatus according to claim 1 further including spring means carried by said work support member opposing the force exerted by the weight of said platen.

8. Apparatus according to claim 4 wherein said platen and said work support member each comprise a solid metal plate with said heating means being mounted in a recess in the said metal plate of said platen.

9. Apparatus according to claim 8 wherein said metal plates have sufficient mass and the heat output of said heating means has sufficient watt density for the temperature of said plates to remain substantailly invariant despite loss of heat from said metal plates to said workpiece.

10. Apparatus according to claim 8 wherein said metal plates are made of aluminum or an aluminum alloy, and further wherein said plates have a thickness of at least about ⅜ inch and said surfaces have a width of at least about 3 inches.

11. Apparatus according to claim 8 wherein said plates are located close to but spaced from said rolls.

12. Laminating apparatus comprising a chassis, a single pair of pressure rolls supported by said chassis and mounted for rotation about their own axes, spring means resiliently biasing said rolls onto pressure engagement with each other, a heating station for guiding a multi-sheet workpiece to be laminated into the nip formed by said rolls, said heating station comprising a work support member fixed to said chassis and a platen located above and resting by its own weight on said work support member, said platen and work support member having flat, confronting and mutually engaging heat conductive surfaces, guide means comprising stationary means carried by said chassis and cooperting means carried by said platen for guiding said platen for movement away from and back toward said work support member so that a workpiece to be laminated may be inserted between said platen and said work support member and positioned in the nip of said rolls, heating means carried by said platen for heating said platen and work support member to a selected temperature, and means for continually rotating at least one of said rolls to draw said workpiece from between said platen and work support member through said rolls so that the sheets of said workpiece are pressed into tight face-to-face engagement with each other by said rolls.

13. Apparatus according to claim 12 wherein said platen has a front end and a rear end with said rear end located nearest to said rolls, and said front end of said platen is bevelled so as to provide an entranceway for said workpiece.

14. Apparatus according to claim 1 wherein said apparatus consists of only a single pair of pressure rolls with the axes of said rolls and the confronting surfaces of said platen and work support member being substantially horizontal.

* * * * *